US007703221B2

(12) United States Patent
Richards et al.

(10) Patent No.: US 7,703,221 B2
(45) Date of Patent: Apr. 27, 2010

(54) SOLE ASSEMBLY

(76) Inventors: Craig Edward Richards, 11 Myall Street, Wallsend, NSW (AU) 2287; Scott Nightingale, 14 Atherton Close, Rankin Park, NSW (AU) 2287

( * ) Notice: Subject to any disclaimer, the term of this patent is extended or adjusted under 35 U.S.C. 154(b) by 361 days.

(21) Appl. No.: 11/721,738

(22) PCT Filed: Dec. 20, 2005

(86) PCT No.: PCT/AU2005/001933

§ 371 (c)(1),
(2), (4) Date: Jun. 14, 2007

(87) PCT Pub. No.: WO2006/066331

PCT Pub. Date: Jun. 29, 2006

(65) Prior Publication Data

US 2009/0265956 A1 Oct. 29, 2009

(30) Foreign Application Priority Data

Dec. 23, 2004 (AU) ..... 2004907276

(51) Int. Cl.
*A43B 13/00* (2006.01)

(52) U.S. Cl. ..... 36/59 R; 36/25 R; 36/103

(58) Field of Classification Search ..... 36/25 R, 36/59 R, 59 C, 27, 28, 103
See application file for complete search history.

(56) References Cited

U.S. PATENT DOCUMENTS 2,319,879 A * 5/1943 Pierson ..... 12/146 B
2,710,461 A * 6/1955 Hack ..... 36/28
2,930,149 A * 3/1960 Hack et al. ..... 36/28
3,000,421 A * 9/1961 Hack et al. ..... 152/209.23
3,444,632 A * 5/1969 Hack et al. ..... 36/32 R
3,717,943 A * 2/1973 Orndorff ..... 36/32 R
3,947,979 A * 4/1976 Sidles ..... 36/32 R
4,274,211 A 6/1981 Funck
4,489,510 A * 12/1984 Williams ..... 36/103
5,337,494 A 8/1994 Ricker
7,047,672 B2 * 5/2006 Hoffer et al. ..... 36/116
7,100,308 B2 * 9/2006 Aveni ..... 36/27

FOREIGN PATENT DOCUMENTS

JP 2002360305 A 12/2002

* cited by examiner

*Primary Examiner*—Marie Patterson
(74) *Attorney, Agent, or Firm*—Carter, Deluca, Farrell & Schmidt, LLP

(57) ABSTRACT

A sole assembly suitable for use in footwear, the sole assembly including a flexible base (12) having an underside surface (13) which includes a forward region (31), a rearward region (32) and an intermediate region (33) therebetween. The sole assembly further includes a plurality of individual sole elements (14) on the underside surface, each element including a body section (15) and a connecting section (17) which is operatively secured to the underside surface (13) of the flexible base (12), the sole elements (14) being arranged on the underside surface of the flexible base such that at least some of the body sections (15) of adjacent sole elements have overlapping sections.

20 Claims, 5 Drawing Sheets

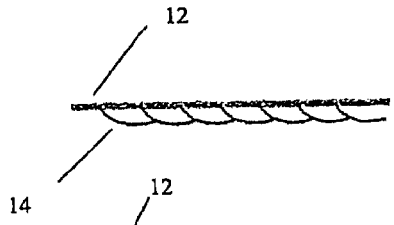
FIG 7(a)
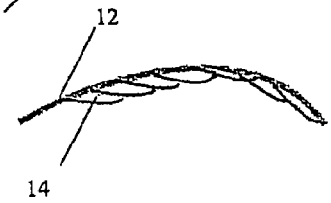
FIG 7(b)
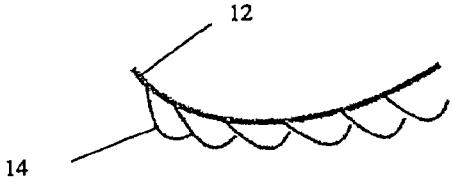
FIG 7(c)
FIG 8(a)
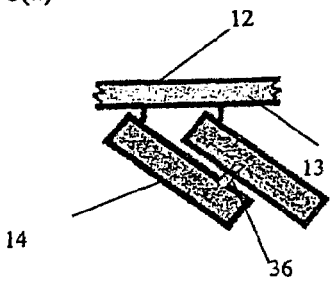
FIG 8(b)
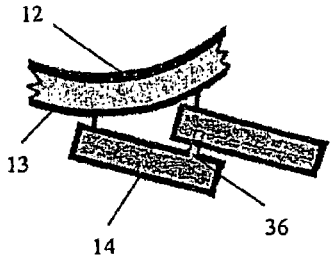
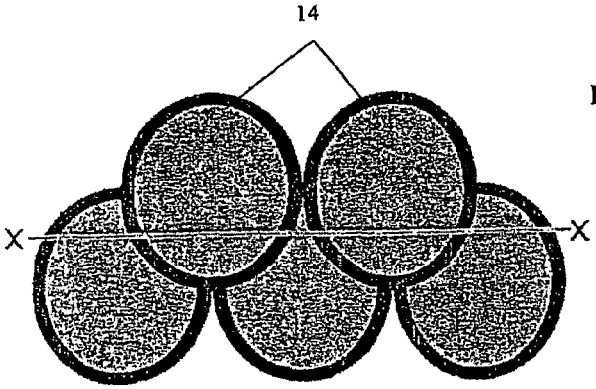
FIG 9(a)
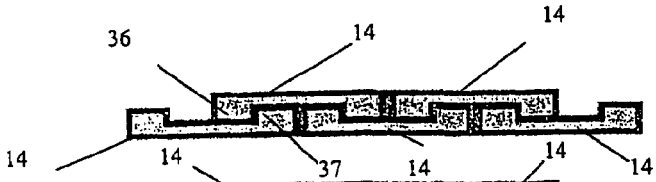
FIG 9(b)
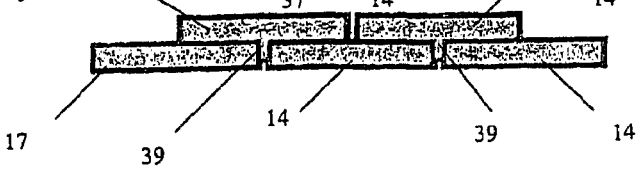
FIG 9(c)

SOLE ASSEMBLY

The present invention relates generally to footwear and more particularly to a sole assembly for use in footwear such as shoes, sandals, thongs or the like.

The present invention seeks to provide an improved assembly which offers increased flexibility, protection and grip over those currently available. The invention seeks to maintain the protective features of known footwear (from, for example, impact, thermal and penetrating injury) whilst reducing the disruption of natural barefoot gait.

According to one aspect of the present invention there is provided a sole assembly suitable for use in footwear, the sole assembly including a flexible base having an underside surface which includes a forward region, a rearward region and an intermediate region therebetween, the sole assembly further including a plurality of individual sole elements on the underside surface, each element including a body section and a connecting section which is operatively secured to the underside surface of the flexible base, the sole elements being arranged on the underside surface of the flexible base such that at least some of the body sections of adjacent sole elements having overlapping sections.

Preferably the overlapping sections of adjacent sole elements are arranged such that during normal flexural movement of the base as a result of motion of the foot at least some overlap of the overlapping sections is maintained.

In one form the base section of each sole element may be generally disc like with the connection section being at an edge portion thereof. In another form the sole elements may be scale shaped including a generally rectangular connection section and a generally semi-circular or arcuate body section. Preferably the connection section of each sole element is disposed forwardly with respect to the body section thereof. It will be appreciated that the sole elements could be oriented in other ways such as with the sole element extending laterally from the connection section with regard to the forward, rearward direction of the sole assembly. The connection section may be operatively connected to the flexible base by any suitable means. For example connection may be via a rivet like element. In another arrangement it may be fused or bonded or the two parts formed as a unitary structure through injection moulding or other manufacturing techniques. In yet another arrangement the sole elements may be naturally curved in shape and are deformable during flexure of the base.

Preferably the abutting overlapping surfaces of adjacent soul elements are in close relation so as to minimise the possibility of foreign objects on the ground infiltrating the space between the sole elements. Furthermore, the contact surfaces between adjacent sole elements enables localised impact forces to be dispersed to a degree. The abutting overlapping surfaces may be complementary in shape and angled or curved so as to assist in inhibiting infiltration of foreign elements. The degree of overlap between adjacent sole elements may vary at selected regions of the flexible base.

Furthermore, at least some sole elements which are adjacent one another and laterally displaced with respect to a direction between the forward and rearward regions of the flexible base may have cooperating edge sections which limit relative lateral movement between the adjacent sole elements.

The contact surfaces of adjacent elements may be friction reduced by having their surfaces relatively smooth or loaded in a lubricant material such as powdered graphite.

The overlap of adjacent sole elements may be only in the forward/rearward direction of the flexible base with rows of the elements being laterally offset with respect to one another.

In another arrangement the adjacent sole elements may overlap both forwardly/rearwardly as well as laterally.

The sole elements may be of any suitable shape and configuration. For example, as mentioned earlier the sole elements may be disc shaped arranged in an overlapping configuration to form a fish scale effect. In another arrangement the sole elements may be disposed adjacent one another so that their edges abut or are spaced apart. In one form, each sole element includes a base section which is operatively connected to the underside surface of the foot support and a cover section. In another arrangement each sole element is formed from a single body. The base section may be formed from any suitable material such as plastics, rubber or metal and from more than one layer of material. The covering section may be formed from any suitable material such as for example, rubber or plastics and from more than one layer of material, so as to extend the wear life of the elements and provide increased grip.

In addition, each sole element may be distinct from others in shape, thickness, or material, or they may all be substantially identical or a combination of a range of factors as appropriate. For example, the sole elements may include a strong base section with a thick, heavy wearing cushioning and covering section at the heel, whereas there may be less cushioning and sole material placed in areas such as the foot arch, which may not encounter as much force as heel areas.

The distribution of sole elements on the sole may be determined by an individual wearer's footprint.

The sole assembly may be operatively connected to an upper, or to straps, laces, or other suitable means of securing to a foot.

Cushioning material may be included in the sole assembly, as a layer above or below the flexible base, in the flexible base or as a layer attached to each sole element.

The flexible base may be of any suitable generally flexible material. The flexibility of the base allows the sole assembly to closely follow the bending of the foot. The base may further be material which may or may not store elastic energy that is it may or may not create a restoring force once taken from its undisturbed position, in bending, torsion or yaw.

In another embodiment, a mounting plate may be provided upon which to mount the sole elements, before being mounted itself to the base. This plate may be constructed from suitable flexible material.

As mentioned earlier, the connecting region between each sole element and the underside surface may be through a point connection or via a bond region. For example, connecting means may be in the form of a filament threaded through or into the sole element and into the foot support or, in another form may be in the form of an adhesive or a fused arrangement or formed as a one piece moulding. In one embodiment some sole elements may be connected in a general forward region thereof with respect to the forward end of the foot of the user, while other may be connected in a general rearward region of the sole element. In one arrangement, the region may cover the entire surface of the sole element.

The assembly may further include a frame which enables a lightweight and flexible base to be used and stretched across the frame with prior or subsequent attachment of the sole elements.

The assembly may be constructed from a single moulded piece, with moulded stems, which may be reinforced, joining the sole elements to the foot support.

Preferred embodiments of the invention will hereinafter be described with reference to the accompanying drawings, and in those drawings.

Figure 4A:
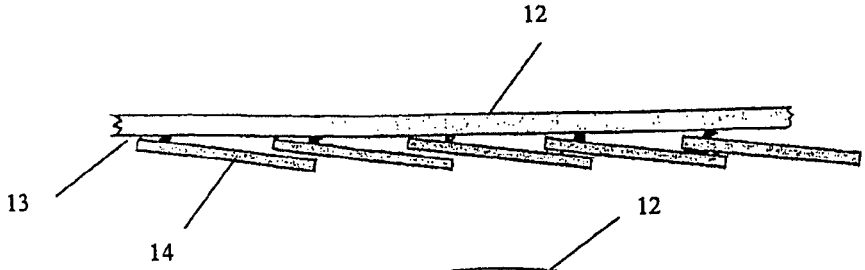
Figure 4B:
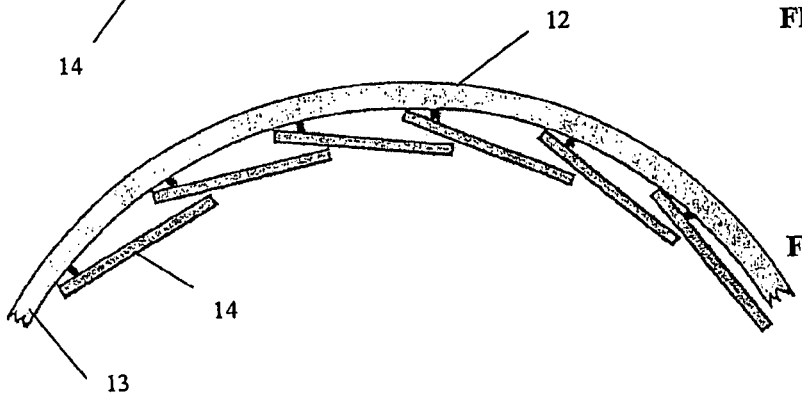
Figure 4C:
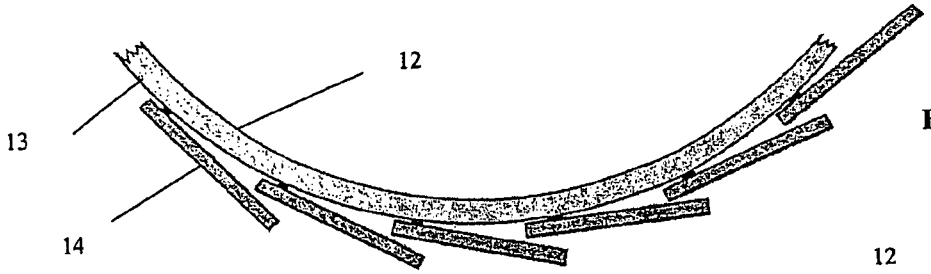

FIGS. 4(*a*), 4(*b*) and 4(*c*) are schematic illustrations of part of the sole assembly according to an embodiment of the present invention.

Figure 5:
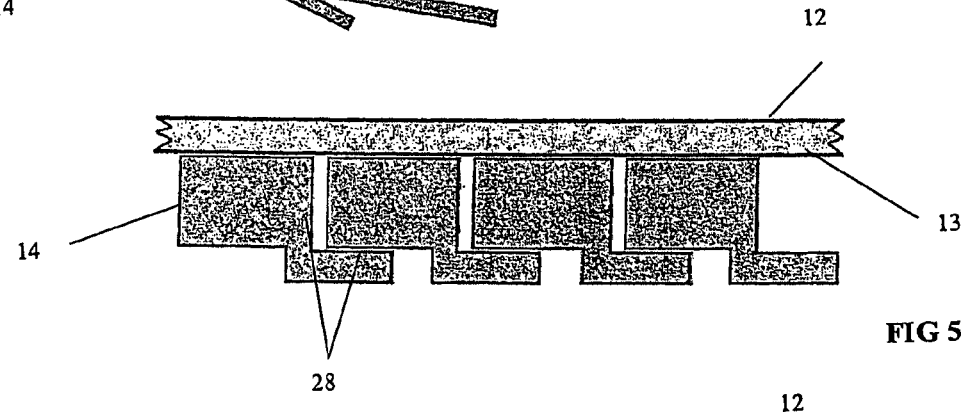
Figure 6:
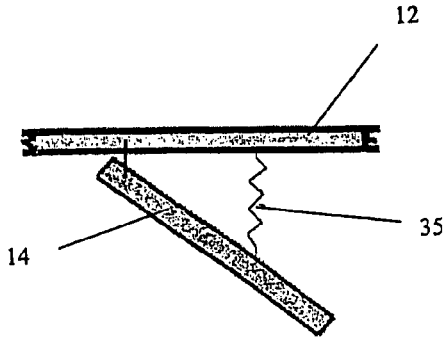

FIG. 5 is a schematic illustration of part of a sole assembly according to another embodiment of the present invention;

FIG. 6 is a schematic illustration of part of a sole assembly illustrating a feature of a further embodiment of the present invention;

FIGS. 7(*a*), 7(*b*) and 7(*c*) are schematic illustrations of yet another embodiment of sole assembly according to the invention;

FIGS. 8(*a*) and 8(*b*) are illustrations of part of a sole assembly showing a feature of a further embodiment of the present invention; and FIGS. 9(*a*), 9(*b*) and 9(*c*) are views of other embodiments of a sole assembly according to the invention.

Referring to the drawings there is shown a sole assembly generally indicated at 10 which includes a flexible base 12 having an underside surface 13. A cushion element 30 may be provided between base 12 and footwear upper 26. The sole assembly further includes a plurality of sole elements 14 having a disc like body section 15 and a connecting section 17 operatively connected to the base by connecting means 20. In the form shown in FIG. 3, the sole elements include a base plate 18 and tread surface 16 operatively connected to one another along abutting faces with adhesive.

Figure 3:
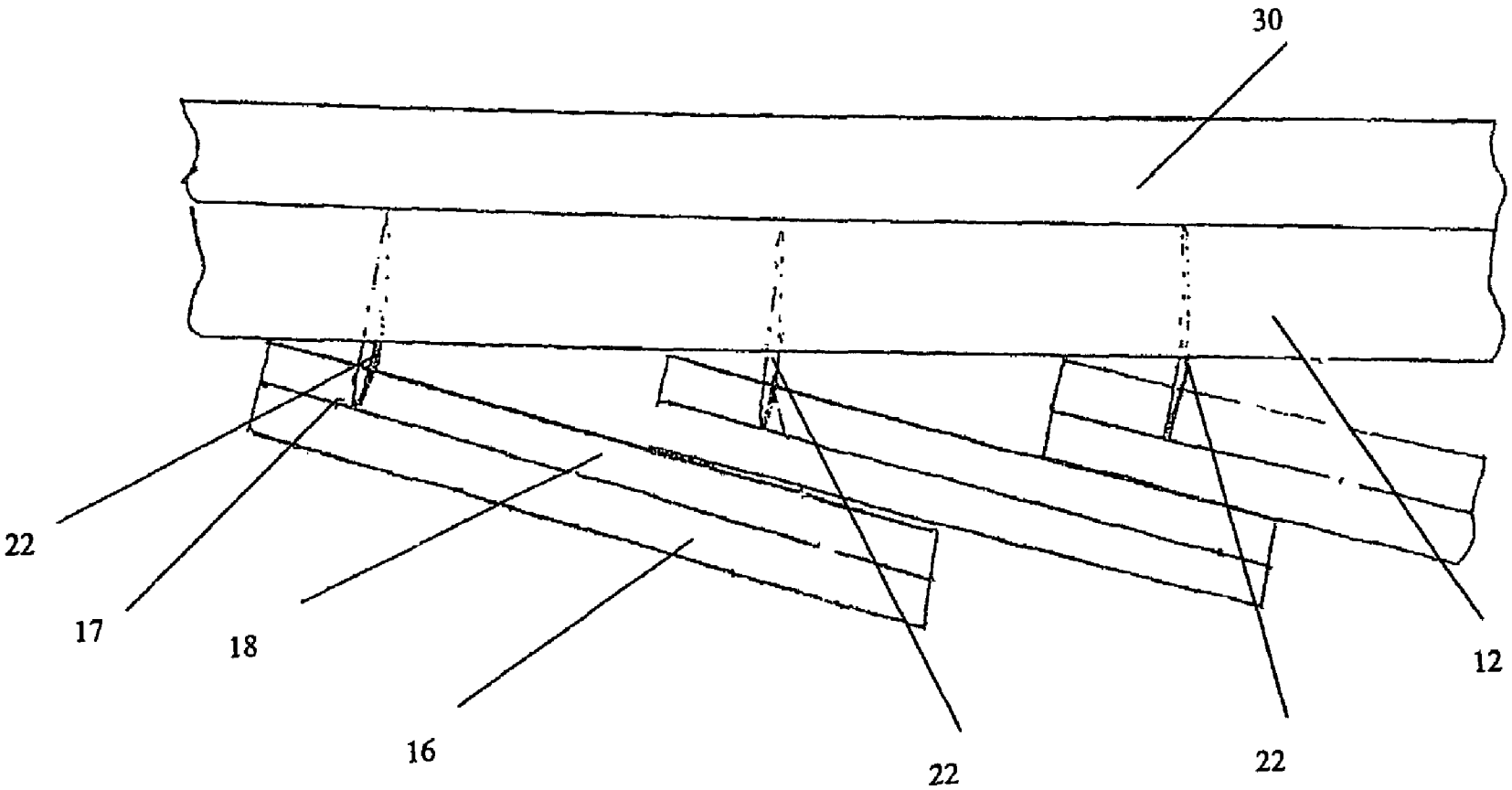
FIG. 3 is a more detailed view of the sole elements.

In the form shown in FIG. 3, the connecting means includes a filament 22 which passes in a loop through and around at least a portion of the plate 18 and through and around at least a portion of the flexible base 12.

Figure 1:
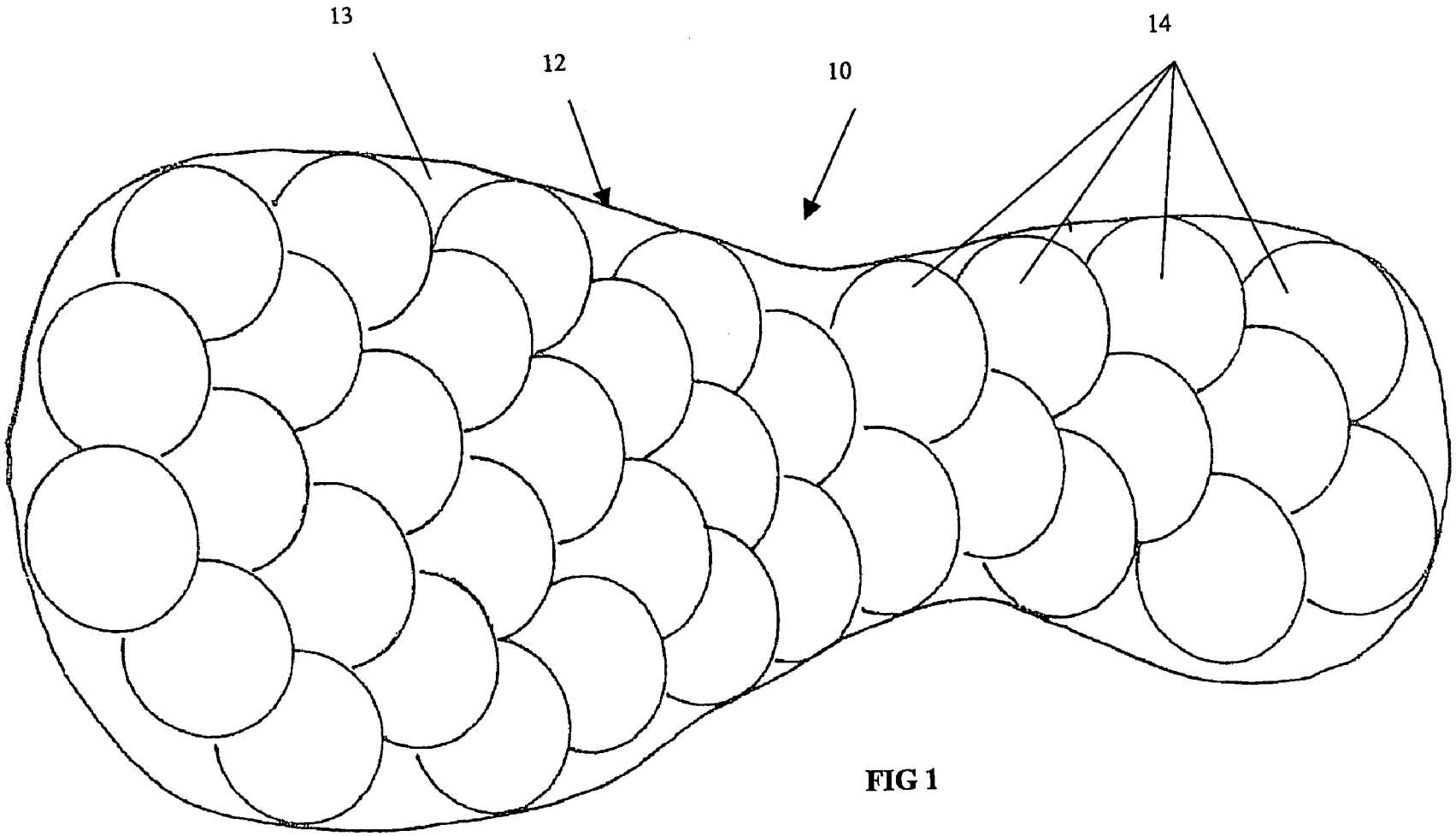
FIG. 1 is a plan view of an example embodiment of the present invention taken from the underside of the sole assembly.
Figure 2:
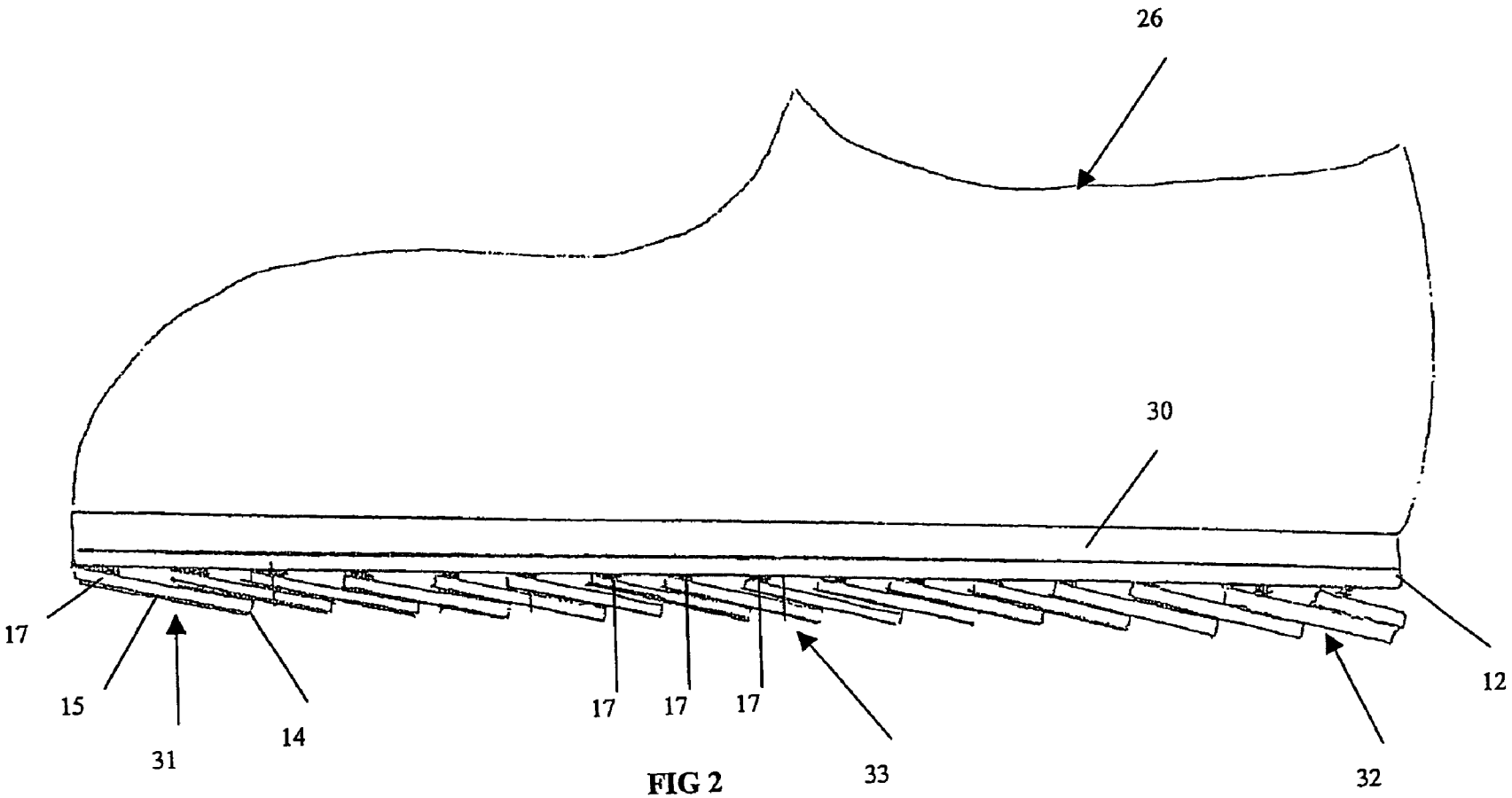
FIG. 2 is a side elevation of footwear incorporating the sole assembly of the present invention.

The footwear upper 26 may be operatively connected to the flexible base 12 of the sole assembly 10 in any suitable fashion. As shown in FIGS. 1 and 3, the underside surface of the flexible base 12 has a forward region 31, a rearward region 32 and an intermediate region 33.

When in use the assembly conforms to the movements of the foot during each step due to the arrangement of sole elements 14 which are advantageously connected to the flexible base 12 via connection sections 17. As shown the connection sections are disposed forwardly with respect to the body section of each sole elements, that is the body sections extend rearwardly with respect to the connecting section of each sole element. In a simple beam subject to bending moment, it is the outer fibres of the beam which resist the bending moment and provide stiffness. In the present invention the outer fibres of the sole have been effectively been broken up and attached to the support only at discrete points or small regions reducing stiffness and increasing flexibility.

Furthermore, when the sole assembly 10 is bent such as in the situation just before a persons rearmost foot is lifted when walking, the present invention provides a greater surface area presented to the ground for grip. This is because the sole elements 14 are only attached at a small area and may pivot about their connecting regions 17 thereby remaining in contact with the ground while the flexible base 12 is bent by the foot and thus raised from ground.

As best seen in FIGS. 4(*a*), 4(*b*) and 4(*c*), in one embodiment adjacent sole elements 14 overlap sufficiently so that they maintain the overlapping relationship when the flexible base 12 if flexed during normal foot motion. FIG. 4(*a*) illustrates the sole elements when the flexible base 12 is flat, FIG. 4(*b*) when the flexure is convex and FIG. 4(*c*) when the flexure is concave.

As shown in FIG. 5, the sole elements 14 can be configured so that the junction between the abutting surface of the overlapping sections provide for a convoluted path so as to inhibit foreign objects entering between the overlapping sections and reaching the underside surface of the flexible base.

As shown in FIG. 6, the sole elements 14 can be biased towards the underside surface of the flexible base. The bias may be effected by an elastic element 35 as shown. In another form the element 35 may not itself be elastic but simply limit the displacement of the sole element away from the flexible base. In another arrangement the bias may be effected by the means of connection of the connecting section of the sole element to the flexible base such as by a rivet or filament with elastic properties. In another arrangement the sole element may be resilient in nature to provide the bias.

As shown in FIGS. 7(*a*), 7(*b*) and 7(*c*), the sole elements 14 can be arcuate in shape and elastically deformable so that the elements tend to straighten when the flexible base is flat but with flexure tend to adopt a curved shape while maintaining an overlapping relation between adjacent elements.

FIGS. 8(*a*) and 8(*b*) illustrate an arrangement for connecting overlapping sole elements together. To this end one sole element has a pin or the like projection 36 from the overlapping surface which is received within a groove in the surface of the adjacent sole element. The arrangement permits relative sliding movement between abutting surfaces but inhibits separation of those abutting surfaces.

FIG. 9 illustrates arrangements whereby lateral movement of adjacent sole elements is inhibited. FIG. 9(*a*) is a plan view of a group of sole elements 14. FIG. 9(*b*) is a sectional view taken along the line X-X in FIG. 9(*a*) showing one manner of limiting the relative lateral movement. In FIG. 9(*b*) cooperating shoulders 36 and 37 limit the lateral movement. FIG. 9(*c*) is a sectional view taken along the line X-X in FIG. 9(*a*) showing a further manner of limiting the relative lateral movement. In this embodiment elongated projection 39 is received within a space between element to limit lateral movement.

It is believed that the sole assembly of the present invention exhibits many advantages over present known assemblies. Set out below are some of these advantages some of which are concerned with the sole assembly as described in its fundamental form and others to the more specific embodiments.

It is believed that only a highly flexible shoe sole will reduce impedance of natural foot motion (during walking, running, jumping and the like) due to footwear, thus increasing biomechanical efficiency and performance (speed, endurance, strength, agility, comfort) whilst reducing risk of injury. Highly flexible shoe soles are capable of moulding to the shape of the foot, and thereby it is believed to reduce the risk of catching the edges of the shoe on objects and also that such flexible soles will reduce the alteration in natural footstrike and gait which occurs in the barefoot state. A highly flexible shoe sole is capable of changing shape with the foot eg lifting the front of the sole as the great toe lifts up just prior to footstrike, thus allowing a shoe sole to be constructed without requiring a tapering of the thickness of the sole towards its front as is a commonly known practice. It is believe that such tapering limits the generation of forward momentum during toe off.

The flexible layer of the assembly can be constructed from a material or materials which are highly flexible and not normally used as a structural element in constructing shoe soles eg woven nylon or kevlar because of their unsuitability with regards to providing cushioning, traction, or being hard wearing. As the flexibility of the sole is largely determined by the flexibility of this layer, shoes can be constructed which are superior in flexibility to existing designs. Shoes of improved flexibility may also be produced which would normally be, relatively inflexible because of either their thickness or because of the intrinsic rigidity of the materials used. Thus materials can be used to construct the sole elements which are intrinsically inflexible but provide other desirable features (eg rigid materials such as polycarbonate which provides excellent protection against penetrating objects and spread point impact forces over their surface area, carbon rubber which is hard wearing and provides excellent traction) without compromising the flexibility of the sole. The ability to use rigid materials which protect the wearer from injury when stepping on small hard objects such as small rocks reduces the need for thick soles constructed from polymer foams such as EVA and polyurethane. Many such shoes soles, particularly sports shoe soles, make this layer thicker than that required to protect against the generalised impact forces involved in running to provide protection against such objects but do so at the expense of increased weight, bulkiness and instability whilst concurrently decreasing the flexibility of the sole. The present invention allows the use of materials with sufficient rigidity to protect against small hard objects, thus allowing the cushioning layer to be reduced in thickness, reversing these unwanted side effects.

By arranging the sole elements so that at least a portion of adjacent sole elements overlap minimises the probability of objects on the ground from being able to pass through the sole without having to penetrate through at least a portion of one of the sole elements (which are constructed from at least one material designed to protect against this). If this overlap is sufficiently large, it will not only protect the foot when the sole is flat, but also when it assumes a concave up configuration and the gaps between sole elements increases.

Utilising overlapping sole elements means that more than one sole element can be involved in absorbing shock during a point impact. This is both because portions of more than one sole element may lay between the foot and the ground, and also because the increased contact between sole elements allows impact forces to disperse more effectively throughout the cushioning material of the sole rather than being restricted to spreading upwards into the foot.

If the two contacting surfaces in the overlapping region of the sole elements are complementary in shape, then this allows them to closely appose. This minimises the space between sole elements that penetrating objects may freely enter and thus reduces the risk of a harmful penetrating through the sole. If complementary ridges and grooves are provided in the upper surface of an overlapping sole element and the lower surface of an overlapped sole element, or a ridge on the upper surface of the overlapping sole element which fits in the space between overlapped sole elements, then these features can be used to control the movement of the sole element about its attachment point. For example, complementary grooves and ridges in the forward rearward direction will prevent a forward attached sole element from rotating laterally about this attachment point when lateral forces are applied, without inhibiting free movement of the pieces relative to each other in the forward-rearward direction. Similarly, an upper surface ridge fitting into the space between the two sole elements it overlaps will achieve this same purpose.

During walking and running, weight is transferred from heel to toe and the heel lifts off the ground as toe off occurs. Similarly, weight is transferred from laterally in the midfoot to medially in the forefoot. As such, the sole of a shoe will also move in this manner with sole elements located in a rearward and lateral location being flexed upwards before those sole elements located in front and medially to them. Thus if overlap were in a forward direction for example, the forward portion of each sole element would still be caught under the sole element in front of it as the sole flexes in this region. Thus if overlap is occurring between sole elements, it is in a rearward and or lateral direction so that the flexibility of the sole is maintained. Overlap in the heelward direction means that the front edge of every sole element is higher than the rear edge, minimising the risk of the front of the sole and or individual sole elements from catching on the ground whilst moving in a forward direction. Overlap in the heelward direction means that the lower most portion of each sole element is orientated backwards when walking or running forwards. This gives the sole elements the potential to be utilised to generate considerable traction, particularly in designs utilising a significant number of small sole elements. Sole elements containing a rigid layer orientated in this rearwardly overlapping direction will provide more efficient energy transfer from the foot to the ground and thus result in greater forward momentum being generated. When combined with cushioning materials, a sole can be constructed which differentially cushions vertical impact forces whilst not damping the rearward forces required for efficient forward motion.

When a sole constructed from a plurality of sole elements is flexed upwards from the edges to form a concave up configuration, the space between adjacent sole elements increases, thus increasing the risk of penetrating injury. This is especially so when the great toe moves upward just prior to footstrike and the ball of the foot assumes this shape, potentially exposing the foot to penetrating injury during the highest impact phase. However, if the sole elements change their orientation when this occurs so that the overlapping regions remain closely opposed, this removes this potentially limiting factor to the scope of the usage of this sole design to include situations where significant protection from penetrating injury is required (eg cross-country running, safety boots etc). By keeping the sole elements closely opposed to the base layer this also decreases the profile of the shoe during concave up thus reducing the risk of catching on the ground.

Specific embodiments of footwear are described below:

FOOTWEAR FIRST EMBODIMENT

Running, Walking General Sports or Fashion Shoe i. the entire ground contacting surface of the sole is formed by surfaces of the sole elements ii. circular or scale shaped sole elements approximately 2-3 cm long, which include a generally rectangular connection section and generally semi-circular or arcuate body section iii sole elements are orientated at an acute angle relative to the connecting layer iv. overlapping surfaces of sole elements are complementary in shape and may be flat, curved, angulated or a combination of the above when viewed from the side v. attached by a forward portion of the sole element only vi. attachment may occur via one or a combination of the following methods 1. a filament passing through a portion of both the sole element and base layer
2. injection moulded directly onto the base layer ie fused
3. a bond region using adhesive 4. sole element and base layer interlock directly (this may form a hinge, ball-socket joint) or a locking device such as a plastic rivet join the two vii. arranged in rows viii. adjacent rows are offset from each other ix. the rear edge (towards the heel) of the sole elements overlaps the forward edge of sole elements in the next row/s such that the flexible layer is not visible from below (ground side) during contact with the ground during toe extension prior to footstrike x. connecting layer is a thin, flexible and relatively inelastic material such as nylon cloth xi. connecting layer need not be a complete sheet and may be in the form of a mesh xii. in the toe region, the connecting layer is sufficiently flexible that where the overlying sole elements are not directly attached, the connecting layer will concertina allowing the sole to shorten as well as flex during toe flexion xiii. provision for a second connection between the sole element and the base layer (or a rearward sole element) which is made rearward of the first attachment point; this may be inelastic and used to limit the degree to which the sole element can rotate away from the base layer, or elastic and used to maintain the sole element flush against the sole element/s it overlaps when the sole is deformed in a concave up configuration xiv. foot support connected to foot via a conventional shoe or boot upper, a sock like structure, straps or the like. May also be directly adhered to foot (in this case the foot support may actually be the skin of the sole of the foot)

xv. the upper provides sufficient upward tension on the edges of the sole that it moulds to the surface of the foot xvi. the toe region of the upper is sufficiently inelastic and closely contacts the foot such that movements of the toes are transmitted to the sole and movements of the shoe sole in this region closely follow those of the toes xvii. the shape of the sole when the shoe is worn approximates the shape of the wearers footprint xviii. sole elements are all the same size and shape except where modification is required on the edges of the sole eg when using scale shaped sole elements, those sole elements with a forward or lateral edge being on the edge of the sole would be replaced with circular sole elements xix. provision for complementary grooving and ridging of the overlapping surfaces of sole elements in the forward/rearward direction to limit the horizontal rotation of sole elements around their attachment points xx. the ground contacting surface of the sole elements may be angular or flat and may have additional components attached eg spikes, sprigs xxi. the sole elements are formed from a material with sufficient rigidity such that the unattached portion of the sole element holds its position relative to the flexible layer, transmits and disperses impact forces through the array and provides the necessary degree of protection from penetrating injury. Suitable materials within this continuum include medium density foams such as EVA and polyurethane, rigid plastics such as polycarbonate xxii. if the element used to form the body of the sole element does not itself provide cushioning, cushioning may be provided by use of a cushioning material as or within, above or below the flexible layer, as the material of the sole elements or as a layer within the sole element xxiii. if the material used to form the sole element is not intrinsically hard wearing eg polyurethane, carbon rubber, a base layer of a such a material may be affixed to the base of each sole element or the portion which contacts the ground xxiv. rows of sole elements may be joined separately eg attached to a mounting plate or moulded as a single piece before being attached xxv. the thickness of the sole elements and or the foot support may be uniform or vary throughout the sole eg becoming gradually thicker toward the heel xxvi. may include an inner sole

FOOTWEAR SECOND EMBODIMENT

Shoe for the Elderly/Disabled i. as per embodiment 1, using a sock like upper whereby both the upper and the flexible connecting layer of the sole are sufficiently elastic that the shoe can be put on using a sock puller device

FOOTWEAR THIRD EMBODIMENT 3

Bicycle Shoe, Ski Boot i. as per embodiment 1 but a portion of the sole is formed by a mounting plate and an attachment point for an external device eg bicycle pedal, snow or water ski and the remainder of the sole is as described

FOOTWEAR FOURTH EMBODIMENT

Running Spike i. only the forefoot region of the sole is constructed as described below with the remainder of the shoe sole being a traditional waffle sole ii. the lower surface of the sole elements are shaped such that the forward region is rectangular and the rearward region is triangular iii. the upper surface of the sole element is comprised of a horizontal rectangular surface, the entirety of which is attached to the foot support and a triangular overlapping region which forms an acute angle with the foot support iv. the rearward aspect of the sole element forms a point v. sole elements are a hard plastic and a thin cushioning layer overlies the foot support

FOOTWEAR FIFTH EMBODIMENT

Soccer Boot i. rectangular sole elements with modification when on perimeter of sole to match outline of foot ii. a significant portion of the upper surface of the sole element is attached to the flexible layer, strengthening the attachment and decreasing the potential leverage which would develop should the edge of the sole element catch on the ground iii. minimal overlap both forward-rearward and laterally (to the left in the left shoe and to the right in the right shoe)

iv. sole elements with sprigs attached may have larger surface area and or overlap v. extensions of sole elements themselves may form sprigs Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

The claims defining the invention are as follows:

1. A sole assembly suitable for use in footwear, the sole assembly including a flexible base having an underside surface which includes a forward region, a rearward region and an intermediate region therebetween, the sole assembly further including a plurality of individual sole elements on the underside surface, each element including a body section and a connecting section which is secured to the underside surface of the flexible base, the sole elements being arranged on the underside surface of the flexible base such that:

at least some of the body sections of adjacent sole elements have overlapping sections; and at least some of the sole elements form a plurality of rows, wherein each row includes a plurality of sole elements and wherein the sole elements of at least one row overlap the sole elements of an adjacent row.

2. A sole assembly according to claim 1 wherein the overlapping sections of the adjacent sole elements is such that during normal flexural movement of the flexible base resulting from motion of the foot at least some overlap of the overlapping sections is maintained.

3. A sole assembly according to claim 1 wherein the base section of each sole element is generally disc like with the connection section being at an edge portion thereof.

4. A sole assembly according to claim 1 wherein the connection section of each sole element is disposed towards the forward region of the flexible base with respect to the body section thereof.

5. A sole assembly according to claim 1 wherein adjacent sole elements have abutting surfaces in the region where they overlap so that the abutting surface are in close abutting relation.

6. A sole assembly according to claim 1 wherein the connection section of each sole element is an integral part of the flexible base.

7. A sole assembly according to claim 1 wherein each sole element comprises a laminate including a body layer and a tread layer.

8. A sole assembly according to claim 1 wherein at least some sole elements which are adjacent one another and laterally displaced with respect to a direction between the forward and rearward regions of the flexible base have cooperating edge sections which limit relative lateral movement between the adjacent sole elements.

9. A sole assembly according to claim 1 wherein the connection section of at least some of the sole elements provides for an articulated or hinged connection.

10. A sole assembly according to claim 1 wherein said body section of said sole elements are biased towards the underside surface of the flexible base.

11. A sole assembly according to claim 10 wherein said sole elements include an elastic element between said underside surface of the flexible base and the body section of said sole section to cause said bias.

12. A sole assembly according to claim 1 wherein said overlapping sections of said adjacent sole elements are coupled together to inhibit separation but enabling relative sliding movement therebetween.

13. A sole assembly according to claim 1 wherein the overlapping abutting surfaces of adjacent sole elements are friction reduced.

14. A sole assembly according to claim 1 wherein said base section of said sole elements are arcuate in shape and deformable in response to flexure of the flexible base.

15. A sole assembly according to claim 2 wherein the connection section of each sole element is disposed towards the forward region of the flexible base with respect to the body section thereof.

16. A sole assembly according to claim 3 wherein the connection section of each sole element is disposed towards the forward region of the flexible base with respect to the body section thereof.

17. A sole assembly according to claim 2 wherein adjacent sole elements have abutting surfaces in the region where they overlap so that the abutting surface are in close abutting relation.

18. A sole assembly according to claim 3 wherein adjacent sole elements have abutting surfaces in the region where they overlap so that the abutting surface are in close abutting relation.

19. A sole assembly according to claim 1 wherein adjacent rows of the sole elements are offset relative to one another.

20. A sole assembly according to claim 1 wherein the sole elements are generally scale shaped, having a generally arcuate body section and a generally rectangular connection section.

* * * * *